US011656047B1

(12) United States Patent
Cole

(10) Patent No.: US 11,656,047 B1
(45) Date of Patent: May 23, 2023

(54) CHAMBER FLAG

(71) Applicant: Sig Sauer, Inc., Newington, NH (US)

(72) Inventor: Jesse D. Cole, Newmarket, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 17/699,621

(22) Filed: Mar. 21, 2022

(51) Int. Cl.
*F41A 17/44* (2006.01)
*F41A 9/53* (2006.01)

(52) U.S. Cl.
CPC ..... *F41A 17/44* (2013.01); *F41A 9/53* (2013.01)

(58) Field of Classification Search
CPC ..... F41A 17/44; F41A 9/53; F41C 27/00
See application file for complete search history.

(56) References Cited

U.S. PATENT DOCUMENTS 2,997,802 A * 8/1961 Robbins ..... F41A 17/44 42/70.11
3,378,943 A * 4/1968 Valburg ..... F41A 17/44 42/70.11
D274,927 S * 7/1984 Child ..... D22/108
4,802,298 A * 2/1989 Baugus ..... F41A 17/44 42/70.11
4,835,894 A * 6/1989 Libassi ..... F41A 17/44 42/70.11
4,965,952 A * 10/1990 Miller ..... F41A 17/44 42/1.05
5,097,613 A * 3/1992 Miller ..... F41A 17/44 42/70.11
5,487,232 A * 1/1996 Osborne ..... F41C 9/08 89/27.13
D415,009 S * 10/1999 Hasselbusch ..... D8/331
6,250,008 B1 * 6/2001 Silver ..... F41A 17/44 42/70.11
6,470,615 B1 * 10/2002 Peterken ..... F41A 17/44 42/70.11
D701,282 S * 3/2014 Ferguson, II ..... D22/108
D716,407 S * 10/2014 Ferguson, II ..... D22/108
8,850,738 B2 * 10/2014 Silver ..... F41C 27/00 42/108
9,810,499 B1 * 11/2017 Silver ..... F41A 15/14
D827,761 S * 9/2018 Rumpke ..... D22/108
D828,477 S * 9/2018 Warburton ..... D22/108
D829,842 S * 10/2018 Silver ..... D22/108
10,094,634 B2 10/2018 Sims

OTHER PUBLICATIONS

Creedmoor Sports Inc, WOA AR-15 Dry Fire Device, available at https://www.creedmoorsports.com/product/woa-ar-15-dry fire-device (retrieved Aug. 3, 2022).

* cited by examiner

*Primary Examiner* — Joshua E Freeman
(74) *Attorney, Agent, or Firm* — Finch & Maloney PLLC

(57) ABSTRACT

Disclosed is chamber flag for a firearm. In one example the chamber flag has a body portion extending along a central axis and a chamber portion extending axially from the body portion, where the chamber portion is sized and configured to be received in a chamber of the firearm. A flag portion extends from the flag body in a direction transverse to the central axis. An arm is connected to the body portion and extends circumferentially around a left side of the body portion in a radially spaced relationship with the body portion, where at least the arm is made of a flexible and resilient material.

20 Claims, 5 Drawing Sheets

CHAMBER FLAG

TECHNICAL FIELD

The present disclosure relates to accessories for firearms. More specifically, the present disclosure relates to a chamber flag.

BACKGROUND

Firearm safety involves a combination of safe practices, mechanical safeties that are part of a firearm, and safety devices that can be added to the firearm or used with the firearm. Examples of safe practices include muzzle control, keeping the finger off the trigger until one is ready to shoot, and never storing live ammunition in the same area where dry-fire training takes place. Mechanical safety mechanisms include passive devices that prevent inadvertent discharge of the firearm, such as a sear or sear device that prevents release of the hammer or striker if the firearm is subjected to an impulse. Mechanical safety mechanisms also include levers and buttons that can be switched by the user between safe and fire mode. Firearm safety further includes devices that are tied to safe practices, such as trigger locks, safes, holsters, and chamber flags.

The chamber flag is an inexpensive device, typically of brightly colored plastic, with an elongated portion that fits into the firearm chamber and a flag portion that protrudes sideways from the firearm, such as in an L-shape. When the chamber flag is installed, the elongated portion obstructs the chamber and prevents the bolt or breechblock from moving to battery, even if the firearm has a loaded magazine installed in the magazine well. The flag portion remains on the exterior of the firearm and is a visual indicator to the user and to others nearby that the firearm cannot be fired. The chamber flag can be retained in the chamber by the forward force applied to the chamber flag by the firearm's bolt or slide. For example, in a semiautomatic handgun, the slide return spring urges the slide towards the battery position and traps the chamber flag between the slide's ejection port and the chamber. Chamber flags can be used when storing a firearm, when transporting a firearm in a vehicle, when carrying a firearm at a range, or when bringing a firearm into a gun store for service, for example.

SUMMARY

One aspect of the present disclosure is directed to a chamber flag for a semiautomatic handgun. In accordance with one embodiment, the chamber flag includes a flexible and resilient arm that extends from the body of the chamber flag. When installed in a semiautomatic handgun, for example, the resilient arm engages an inside surface of the slide and retains the position of the chamber flag within the ejection port of the slide. Accordingly, the chamber flag need not rely on the force of the return spring to stay in place and the chamber flag can be used while the slide is cycled, such as during dry-fire training. In some such embodiments, the chamber flag reciprocates with the handgun slide and returns forward to block the chamber when the slide moves forward.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1A:
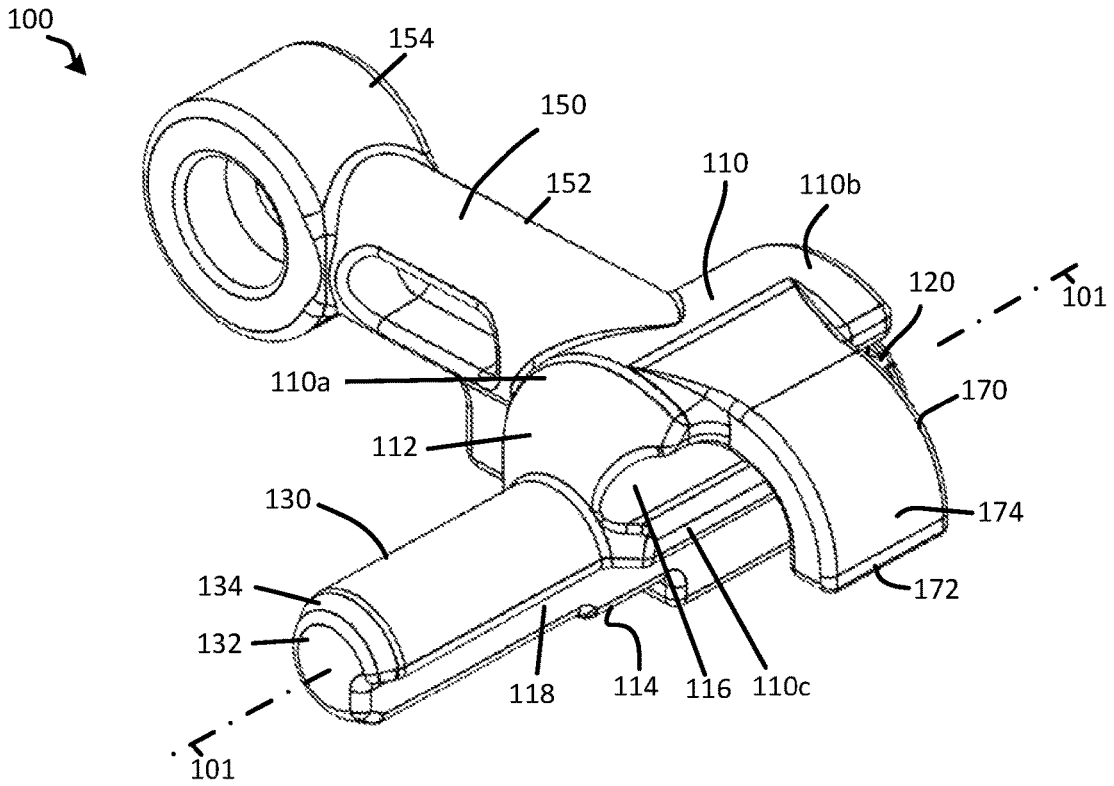
FIG. 1A is a front perspective view of a chamber flag, in accordance with an embodiment of the present disclosure.

The figures depict various embodiments of the present disclosure for purposes of illustration only. Numerous variations, configurations, and other embodiments will be apparent from the following detailed discussion.

DETAILED DESCRIPTION

In accordance with one embodiment, a chamber flag for a semiautomatic handgun includes a body portion oriented along a central axis and a chamber portion extending from the body portion along the central axis. The chamber portion is sized to be slidably received in the chamber of the handgun. In some embodiments, the chamber portion is freely or easily movable in the handgun's chamber. A flag portion extends away from the body portion in a direction transverse to the central axis (e.g., perpendicular to the central axis). The flag portion is configured to remain outside of the chamber when installed in the handgun to provide a visual indication that the chamber is devoid of ammunition. A retaining arm is connected to the body portion and extends circumferentially around part of the body portion in a spaced relationship with the body portion. A proximal end of the body portion can include geometry that mates with the breech face of the handgun. The retaining arm, and even the chamber flag as a whole, is made of a flexible and resilient material such that the retaining arm can be deformed from its resting state when installed in the chamber of a handgun. In combination with the retaining arm engaging an inside surface of the slide, and with features that mate with surfaces of the slide and/or breechblock, the chamber flag remains coupled to the slide. As such, the chamber flag will remain in place as the slide is cycled manually.

OVERVIEW

Existing chamber flags often are made of hard plastic and define an L-shape with one leg of the L sized to fit in the chamber, and the other leg of the L extending from the gun's chamber when installed. In the context of a semiautomatic handgun, such existing chamber flags are held in the chamber by the force of the return spring driving the slide forward against the chamber flag so that it is trapped between the chamber (defined by the barrel or the frame) and the ejection port of the slide. So long as the slide maintains its forward force against the chamber flag, it will remain in place. However, when the slide is moved rearward, the retaining force on the chamber flag is lost and the chamber flag can easily fall out of the chamber.

Based on these existing chamber flags, the user may remove the chamber flag and set it aside when he or she desires to conduct dry-fire training. Dry-fire training often involves exercises that include reloads, clearing the chamber, engaging a target, and pulling the trigger to simulate firing a round, among other actions. Dry-fire training is often performed with dummy ammunition or "snap caps". This dummy ammunition can include a polymer or metal insert in place of the ammunition primer that interrupts firing pin travel. However, the inserts wear out quickly and need to be replaced frequently. Sometimes the user may not realize the dummy ammunition is worn and continues to use it. Dry-fire training conducted without dummy ammunition or conducted with worn out dummy rounds causes undue wear on firing pin stop features and may result in worn or broken components. Additionally, some dummy ammunition looks very much like live ammunition. Even when it does not, if the chamber flag is not in place, the possibility remains that the user may accidentally load a live round into a magazine and, during the course of dry-fire training, chamber and fire the live round. At the very least, great surprise would result; at worst, significant injury or death could result.

In light of the foregoing, a need exists for improvements to dry-fire training tools. A need also exists for a chamber flag that can be used during dry-fire training. The present disclosure addresses these needs and others by providing a chamber flag configured to remain coupled to the handgun slide as it is cycled manually. A chamber flag according to some embodiments interrupts the firing pin (or striker) travel. In some embodiments, a chamber flag remains coupled to the slide as it is cycled, thereby preventing live ammunition from accidentally being chambered during dry-fire training or other situation. Further, since the chamber flag remains coupled to the slide during dry-fire training, the slide is prevented from moving fully forward to battery. In the out-of-battery position, the breech block's hammer ramp obstructs the hammer from striking the firing pin.

A chamber flag as variously disclosed herein advantageously improves safety during dry-fire training by remaining coupled to the slide. Additionally, the chamber flag reduces wear and tear on the fire control components by either interrupting firing pin travel or causing an out-of-battery position in which the hammer cannot strike the firing pin. The chamber flag as variously disclosed herein can be used in, but is not limited to, hammer-fired and striker-fired semiautomatic handguns that use a blowback or recoil operation. Other firearms can benefit from the principles disclosed herein. Examples of suitable firearms include blowback-operated handguns, such as handguns chambered for rimfire ammunition. One such handgun is the P322 handgun by Sig Sauer Inc. Other firearms suitable for use with the chamber flag include semiautomatic handguns chambered in 9 mm, 45 ACP, or other pistol ammunition and operating using a recoil system of operation. Numerous variations, advantages, and embodiments will be apparent in light of the present disclosure.

As used herein, terms referencing direction, such as upward, downward, vertical, horizontal, left, right, front, back, etc., are used for convenience to describe a chamber flag for a handgun, where the handgun is oriented in a traditional shooting position with the barrel extending horizontally in front of the user, and/or where the chamber flag is oriented in a position for use with the handgun oriented in the traditional shooting position. Embodiments of the present disclosure are not limited by these directional references and it is contemplated that a firearm and chamber flag in accordance with the present disclosure could be used in any orientation.

Also, it should be noted that, while generally referred to herein as a 'chamber flag' for consistency and ease of understanding the present disclosure, the disclosed chamber flag is not limited to that specific terminology and alternatively can be referred to, for example, as a safety flag, a chamber insert, a flag, a chamber safety device, or other terms.

EXAMPLE EMBODIMENTS

Figure 1B:
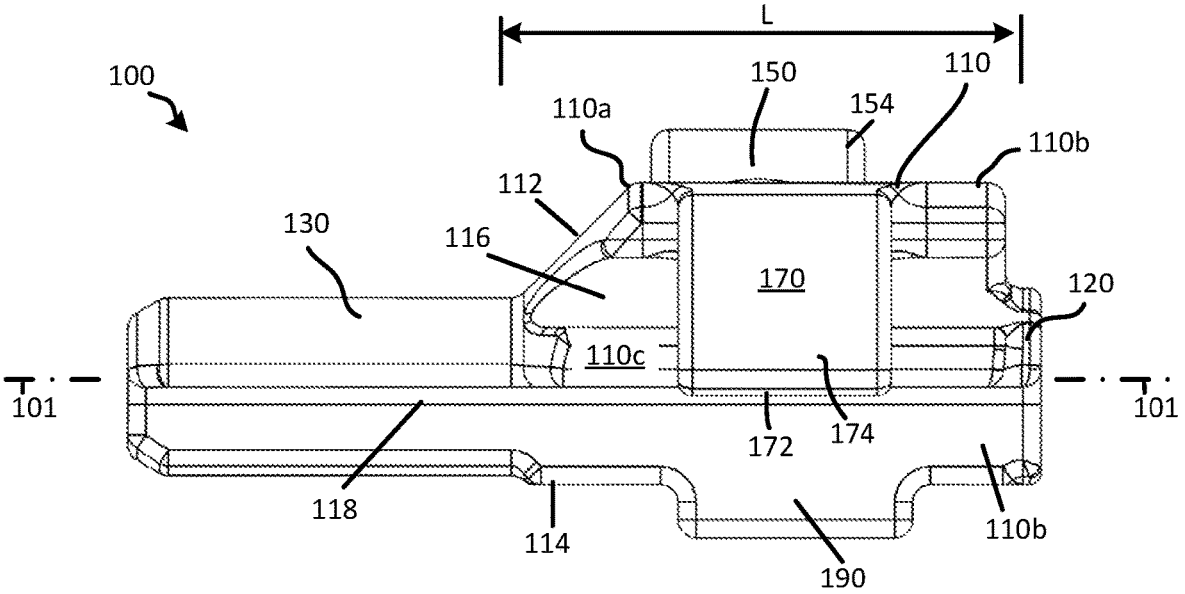
FIG. 1B is a side view showing a left side of the chamber flag of FIG. 1A.
Figure 1C:
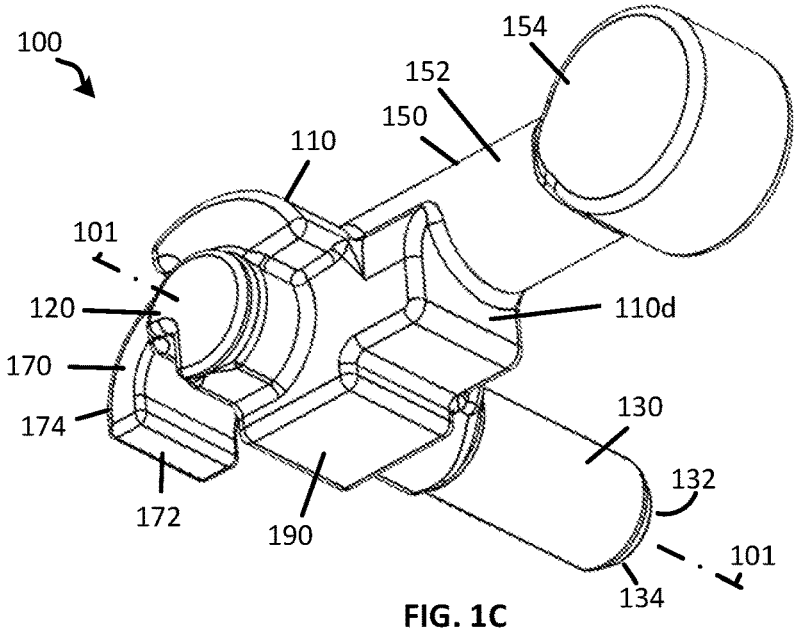
FIG. 1C illustrates a bottom and rear perspective view of the chamber flag of FIG. 1A.
Figure 1D:
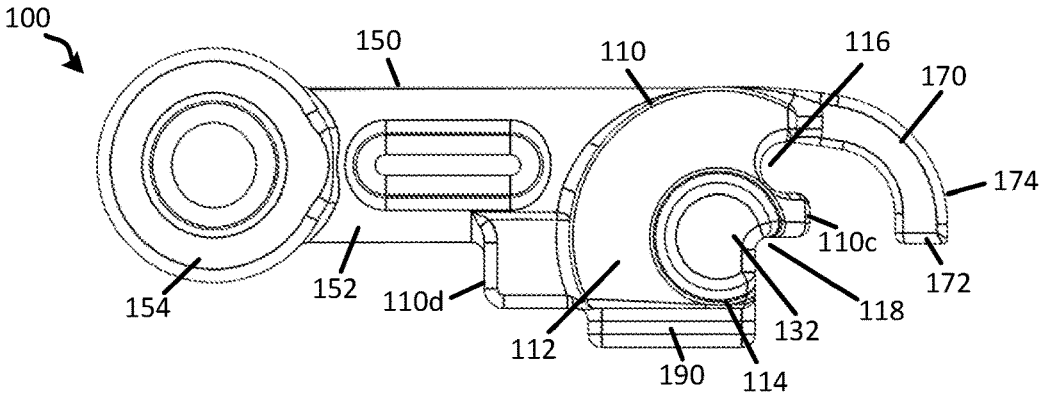
FIG. 1D is a front view of the chamber flag of FIG. 1A.
Figure 1E:
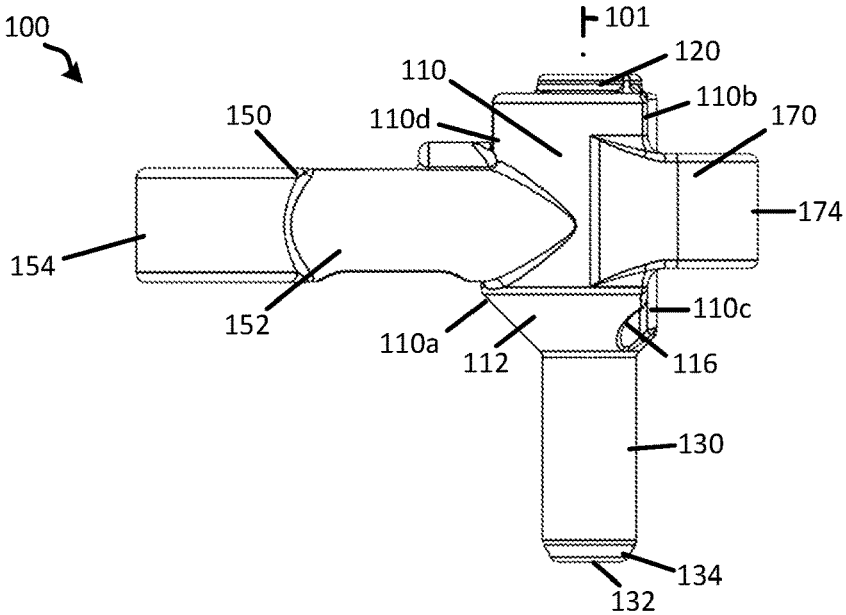
FIG. 1E is a top view of the chamber flag of FIG. 1A.

FIGS. 1A-1E illustrate various views of a chamber flag 100, in accordance with an embodiment of the present disclosure. FIG. 1A is a front perspective view, FIG. 1B is a side view showing the left side 110*c*, FIG. 1C is a bottom and rear perspective view, FIG. 1D is a front elevational view, and FIG. 1E is a top view. FIGS. 1A-1E are discussed concurrently below.

The chamber flag 100 has a body portion 110 oriented along a central axis 101. In some embodiments, the body portion 110 can have a cylindrical geometry from which recesses are formed. A cuboid or other geometry is also acceptable. The body portion 110 can have an axial length L suitable to maintain the slide or breechblock in a desired out-of-battery condition. For example, the body portion o110 can have an axial length L from 5 to 20 mm, or about 15 mm.

In this example, a first portion of the distal end portion 110*a*, such as an upper portion of the distal end portion 110*a*, defines a frustoconical taper 112. A second portion opposite of the frustoconical taper 112, such as a lower portion, defines a shelf 114 with a planar surface. The shelf 114 is positioned vertically below a bottom of the chamber portion 130. An upper or first groove 116 is located above the central axis 101 and extends longitudinally through the left side 110*c* of the body portion 110. A lower or second groove 118 is located below the central axis 101 and extends longitudinally through the left side 110*c* of the body portion 110 and chamber portion 130. The terms "upper," "lower," "left," and "right" used here refer to the chamber flag 100 oriented in an as-installed position in a handgun, where the chamber portion 130 extends distally, and where the flag portion 150 extends horizontally from the right side of the body portion 110. The first groove 116 increases the flexibility of the retaining arm 170, which is discussed in more detail below. The second groove 118 provides clearance for components of the handgun, such as the ejector or slide catch lever. In some embodiments, the proximal end portion 110*b* can be shaped to mate with a breechblock or slide of a particular handgun. For example, the breechblock can be a component that is distinct from the slide or can be machined as part of the slide.

In this example, the proximal end portion 110*b* includes a rear protrusion 120 of reduced diameter compared to the body portion 110. Specifically, the rear protrusion 120 is sized and shaped to be contact the breechface of the firearm's breechblock. In the example shown, the chamber flag 100 is sized for a handgun chambered for .22 LR ammunition and having a recessed breechface, so the rear protrusion 120 is sized the same size or slightly smaller than the rim of .22 LR ammunition, which has an outer diameter of 0.278 inch. When the chamber flag 100 is intended for firearms of other caliber, the rear protrusion 120 can be sized accordingly. The rear protrusion 120 in this example has a diameter from 0.20-0.24 inch (5.1-6.1 mm), including 0.21-0.22 inch (5.3-5.6 mm). The rear protrusion 120 engages the breechface to assist in maintaining the chamber flag 100 coupled to the slide assembly. The rear protrusion 120 also is configured to align with the firing pin and interrupt its travel (if any). In other embodiment, the proximal end portion 110*b* can be flat (i.e., with no rear protrusion 120) or the rear protrusion 120 can have some other geometry. For example, the rear protrusion 120 can have a cross-sectional shape of a vertically oriented rectangle or a square with dimensions suited for the intended firearm. Numerous variations and embodiments will be apparent in light of the present disclosure.

A chamber portion 130 is connected to and extends longitudinally from the distal end portion 110*a* along the central axis 101. The chamber portion 130 is sized and generally shaped similar to the case of an ammunition round to be received in the chamber for which the chamber flag 100 is intended. In this example, the chamber portion 130 is generally cylindrical, except for the second groove 118 extending therethrough. A distal end 132 of the chamber portion 130 can be rounded or chamfered to facilitate entry into the gun's chamber. In this example, the chamber portion 130 has an end chamfer 134 that results in a frustoconical shape at the distal end 132.

The chamber portion 130 has a diameter that is smaller than the caliber of the chamber for which the chamber flag 100 is intended. For example, for a handgun chambered for .22 LR, a round which has a case with a diameter of 0.226 inch (5.75 mm), the chamber portion 130 can be slightly or significantly smaller in diameter, such as having a diameter from 0.15-0.22 inch (3.8-5.6 mm), including a diameter of 0.18 inch (4.57 mm), a diameter of 0.20 inch (5.1 mm), a diameter of 0.21 inch (5.33 mm), and diameters below 0.15 inch. In one embodiment, the chamber portion 130 has a diameter of about 5 mm. The chamber portion 130 can have a length from a few millimeters to tens of millimeters. In one example, the chamber portion 130 has an axial length L of about 10 mm. Whether the intended handgun is chambered in .22 LR or other ammunition, the chamber portion 130 can have a diameter and a length deemed appropriate for the material of the chamber flag, manufacturing tolerances, and desired fit and resistance in the chamber.

A flag portion 150 is connected to and extends from a right side 110*d* of the body portion in a direction transverse to the central axis 101. Typically, the flag portion 150 extends at 90° to the central axis 101. The flag portion 150 can have any one of a variety of lengths, shapes, and end portions as deemed suitable for use as a handle and/or for use as a visual indicator. In the example shown, the flag portion 150 includes a generally cylindrical shaft or post 152 that terminates in a flag 154 of cylindrical or disk shape. In some embodiments, the flag 154 defines a through opening for attachment of an additional label, for example. In some embodiments, the post 152 of the flag portion 150 connects to an upper half or upper portion of the body portion 110 so as to position the post 152 above the surface of the ejection port 206 of the handgun's slide 202 (shown, e.g., in FIG. 4). When installed in the slide 202, the flag portion 150 can extend horizontally out of the ejection port 206. The horizontal position of the flag portion 150 is not required and in other embodiments the flag portion 150 is configured to extend upward from the body portion 110 at any angle within the range permitted by the ejection port 206.

A retaining arm 170 is connected to and extends from the left side 110*c* of the body portion 110, where the retaining arm 170 is spaced from the body portion 110 along its length. In one example, the retaining arm 170 connects to a top of the body portion 110 and curves laterally outward and downward to an end 172 and defining an arc spanning from 60-180° , such as from 90°-120°, from 80°-100°, or about 90°. An outside surface 174 of the retaining arm 170 is intended to frictionally engage an inside surface of the handgun slide.

A blocking portion 190 protrudes from the bottom of the body portion 110. The blocking portion 190 is sized to extend downward sufficiently to prevent a loaded magazine from being seated in the chamber. The blocking portion 190 is shown as having a planar face and rectangular geometry, but other configurations can be used. In some embodiments, the blocking portion 190 is sized to be received between the feed lips of the magazine so that when a magazine is installed in the magazine well, the blocking portion 190 is received in the space normally occupied by the top-most round of the magazine.

The resiliency of the retaining arm 170 and frictional engagement with the firearm slide, in combination with the rear protrusion 120 engaging the breechface, provides a frictional force sufficient to couple and retain the chamber flag 100 with the slide when the slide is cycled manually. For example, in its installed position, the rear protrusion 120 abuts a breechface that is recessed with respect to the surrounding portions of the breechblock, the retaining arm 170 engages the left inside surface of the slide, and the chamber portion 130 extends distally towards or into the chamber. In some embodiments, the right side 110*d* of the body portion 110 can be sized and configured to abut the right inside wall of the slide when installed. The chamber flag 100 may have additional points of contact with the handgun and chamber help to stabilize the chamber flag 100 when installed in the slide.

Figure 2:
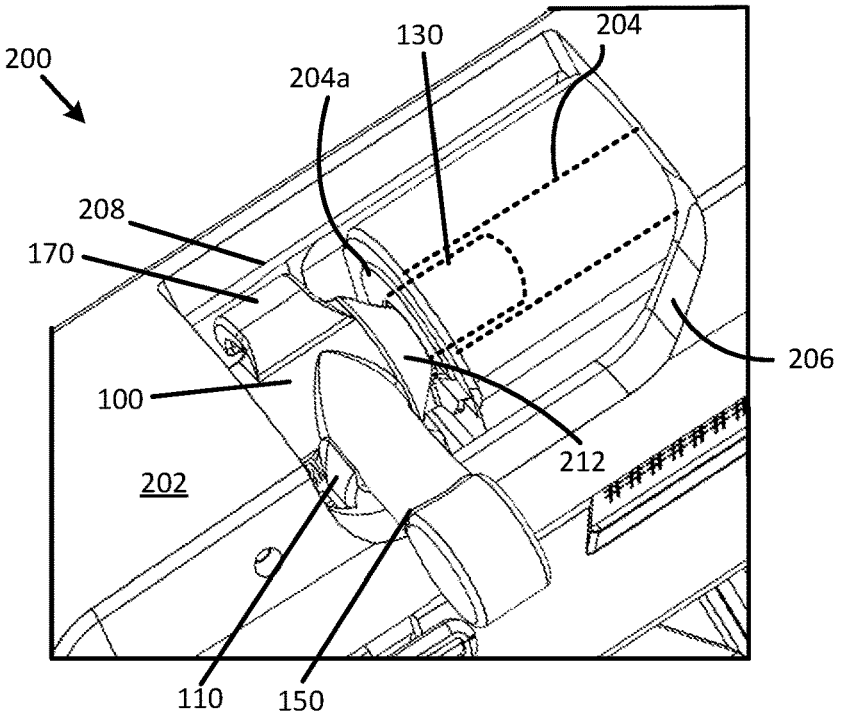
FIG. 2 illustrates a top and rear perspective view showing part of a handgun with a chamber flag installed in the chamber, in accordance with an embodiment of the present disclosure.
Figure 3:
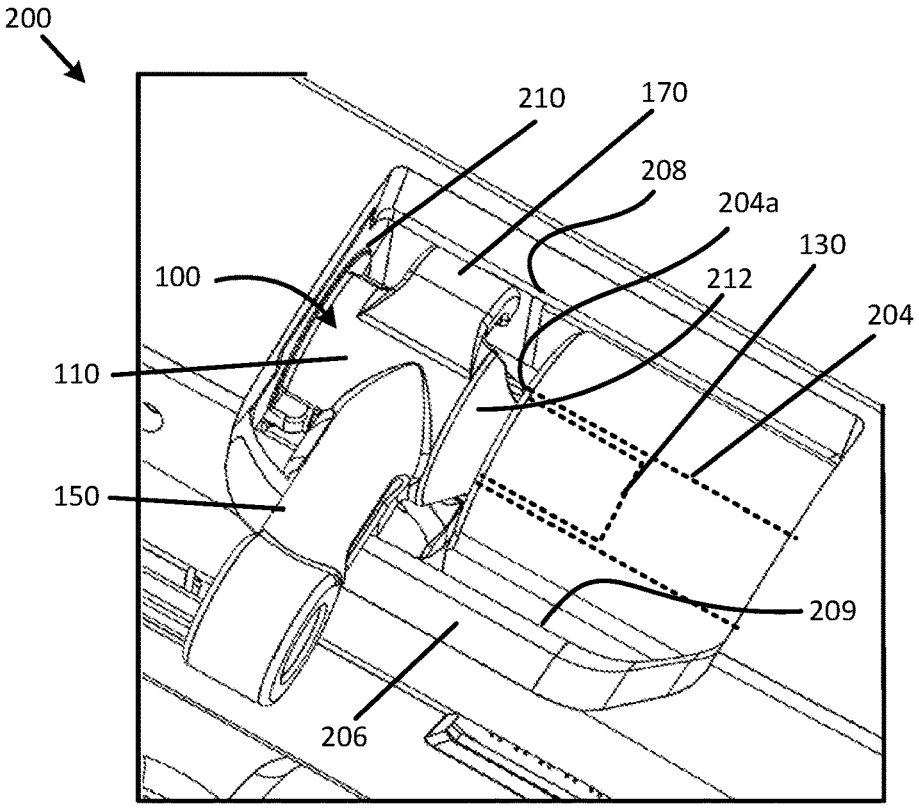
FIG. 3 illustrates a top and side perspective view showing part of a handgun with a chamber flag installed in the chamber, in accordance with an embodiment of the present disclosure.

Referring now to FIGS. 2 and 3, top perspective views show part of a handgun 200 with a chamber flag 100 installed in the slide 202. In this example, the chamber portion 130 extends into the chamber 204 and the frustoconical taper 112 abuts the breech 204*a*. The retaining arm 170 engages the inside surface of the left wall 208 of the slide 202. In doing so, the retaining arm 170 may be slightly deflected or deformed towards the body portion 110 compared to a resting position such as shown in FIGS. 1A-1E. That is, the retaining arm 170 can be temporarily deformed or bent towards the body portion 110 so that the distance between the body portion 110 and the end 172 of the retaining arm 170 is reduced. Due to the resiliency of the material of the chamber flag 100, this deformation of the retaining arm 170 provides a spring force that pushes the rear protrusion 120 against the recess of the breechface 212, pushes the body portion 110 against the inside surface of the right wall 209 of the slide 202 adjacent the ejection port 206, and/or pushes the chamber portion 130 against the wall of the chamber 204.

Figure 7:
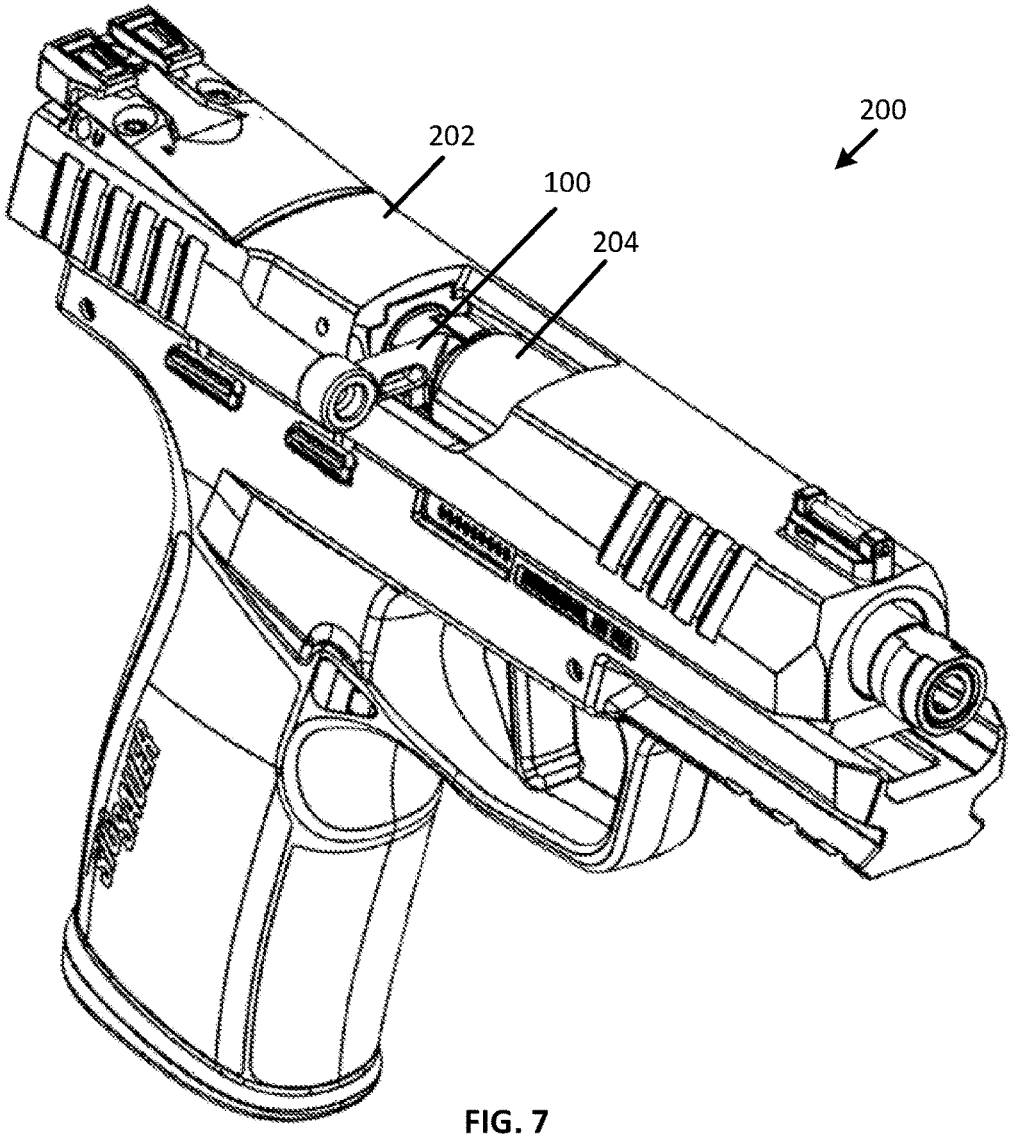
FIG. 7 is a front perspective view of a handgun with the chamber flag installed in the slide, in accordance with an embodiment of the present disclosure.

As best shown in FIG. 3, the body portion 110 is positioned axially between the breech 204*a* and the breechblock 210 with the rear protrusion 120 (not visible) received in the recess of the breechface 212 (shown in FIG. 7). The flag portion 150 extends horizontally out of the ejection port 206 of the slide 202.

Figure 4:
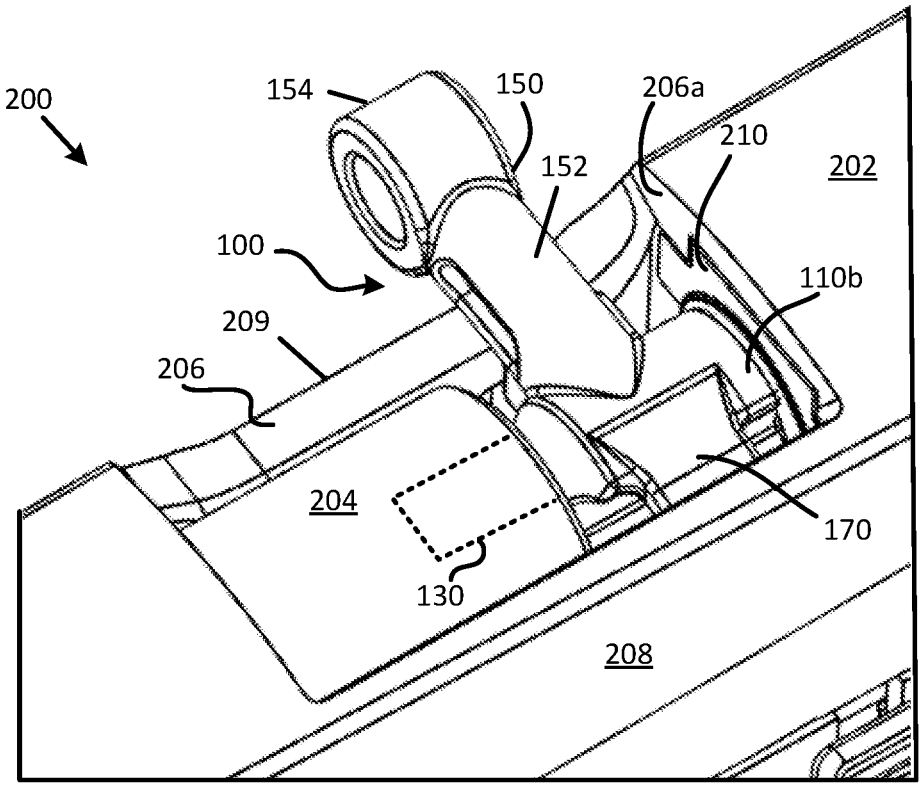
FIG. 4 illustrates a top and front perspective view showing part of a handgun with a chamber flag installed in the chamber, in accordance with an embodiment of the present disclosure.

FIG. 4 illustrates a top and front perspective view of part of a handgun 200 with the chamber flag 100 installed in the slide 202. In this example, the slide 202 is in a forward toward the battery position to the extent permitted by the chamber flag 100. The breechblock 210 can be seen at the proximal end 206*a* of the ejection port 206. The rear protrusion 120 abuts the breechface 212 (not visible) which is recessed into the breechblock 210. Accordingly, the proximal end portion 110*b* abuts the breechblock 210 and the chamber portion 130 is received in the chamber 204. The retaining arm 170 engages the inside surface of the left wall 208 of the slide 202. The flag portion 150 extends horizontally out of the ejection port 206 with the post 152 in contact with the top of the right wall 209 or spaced above it and with the flag 154 positioned outside of the slide 202.

Figure 5:
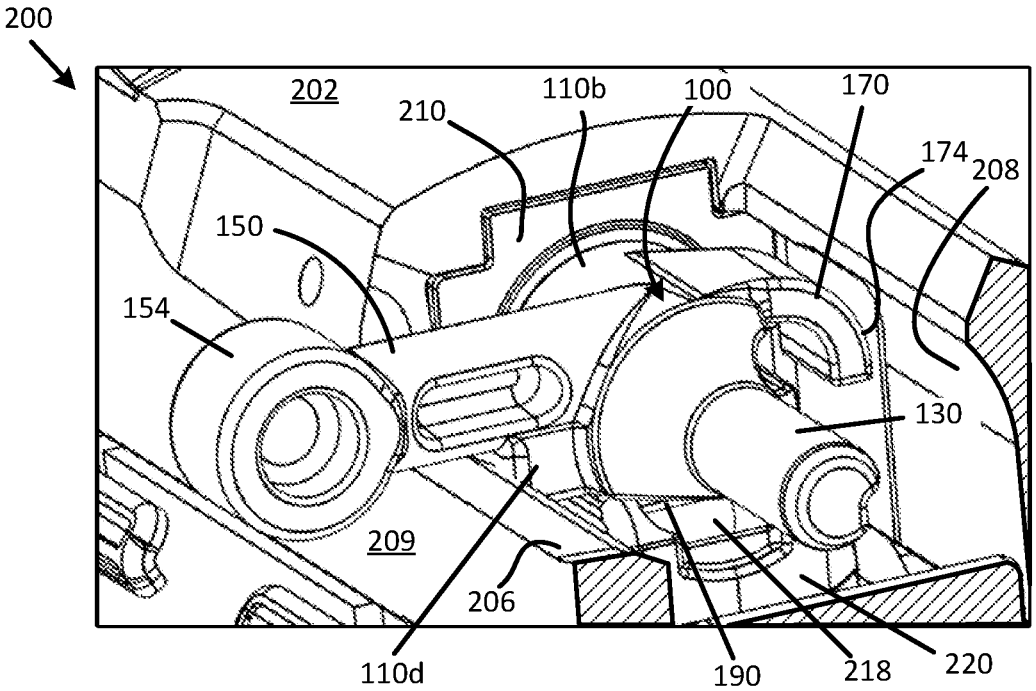
FIG. 5 illustrates a partial cross-sectional and front perspective view of part of a handgun with a chamber flag installed in the slide, in accordance with an embodiment of the present disclosure.

FIG. 5 illustrates a cross-sectional, front perspective view of part of a handgun 200 showing a chamber flag 100 installed in the slide 202, in accordance with an embodiment of the present disclosure. In this example, the section is taken through a forward portion of the ejection port 206. The chamber flag 100 is retained in the slide by frictional forces whether or not the chamber portion 130 extends into the chamber 204 (shown, e.g., in FIGS. 2-3). The outside surface 174 of the retaining arm 170 engages the inside surface of the left wall 208 of the slide 202 and is slightly deformed towards the body portion 110. The proximal end portion 110*b* of the body portion 110 abuts the breechblock 210 and the right side 110*d* of the body portion 110 abuts the inside of the right wall 209 of the slide 202. The blocking portion 190 abuts the top-most cartridge 218 retained in a magazine 220, preventing the magazine 220 from seating in the magazine well. The flag portion 150 extends over the right wall 209 along the ejection port 206 so that the flag 154 is positioned outside of the ejection port 206. As the slide 202 is cycled by hand, the chamber flag 100 will remain in the slide 202 by frictional forces.

Figure 6:
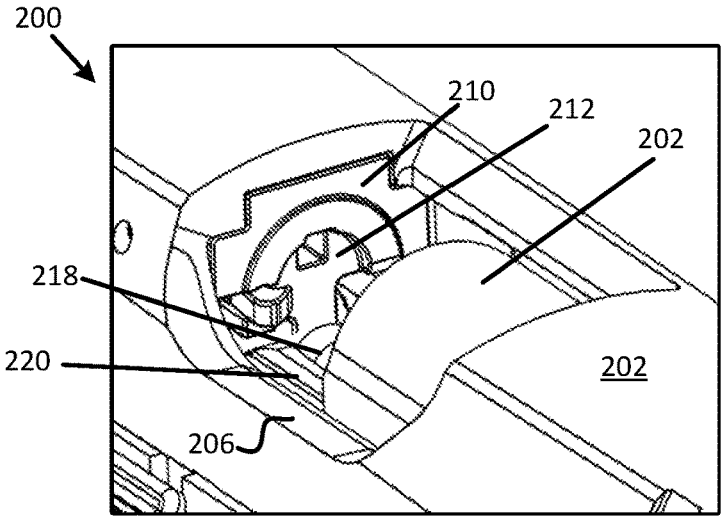
FIG. 6 illustrates a front perspective view of a slide of semiautomatic handgun and shows the breechface, in accordance with an embodiment of the present disclosure.

FIG. 6 illustrates a perspective view looking into the ejection port 206 of a handgun slide 202. The chamber 204 is spaced from the breechblock 210 at the proximal end of the ejection port 206. The breechface 212 is recessed relative to the surrounding portions of the distal end of the breechblock 210. The top of the magazine 220 with top-most cartridge 218 are also shown.

FIG. 7 illustrates a front perspective view of a handgun 200 with a chamber flag 100 installed in the slide 202 and the slide 202 in an out-of-battery position, in accordance with an embodiment of the present disclosure. In this example, the slide 202 is urged forward by the recoil return spring (not shown) so that the chamber portion 130 (not visible) is received in the chamber 204.

In use, a chamber flag 100 as disclosed herein advantageously provides improved handgun safety due to the chamber flag 100 remaining installed in the slide 202 when the slide is cycled. Thus, the user may install the chamber flag 100 to provide a visual indicator that the chamber is obstructed from ammunition while continuing to use the handgun 200 for dry-fire practice. In doing so, the chamber flag 100 remains installed in the slide as the user cycles it and the chamber flag 100 continues to block the chamber from loading ammunition. Additionally, the chamber flag 100 prevents the user from seating a loaded magazine into the handgun. Therefore, when the chamber flag 100 is installed, it reduces or eliminates the opportunity for inadvertently firing live ammunition by preventing a magazine from seating in the magazine well and also preventing a round (live or dummy) from being chambered. As an additional advantage, the user may move the slide rearward intentionally or inadvertently without loss of the chamber flag 100. The chamber flag 100 is not limited to use with a semiautomatic handgun and can be used in any suitable firearm, as will be appreciated. Numerous variations and embodiments will be apparent in light of the present disclosure.

FURTHER EXAMPLE EMBODIMENTS

The following examples pertain to further embodiments, from which numerous permutations and configurations will be apparent.

Example 1 is a chamber flag for a firearm, the chamber flag comprising a body portion extending along a central axis; a chamber portion extending axially from the body portion, the chamber portion sized and configured to be received in a chamber of the firearm; a flag portion extending from the flag body in a direction transverse to the central axis; and an arm connected to the flag body and extending circumferentially around a left side of the flag body in a radially spaced relationship with the flag body, where the arm is made of a flexible and resilient material.

Example 2 includes the subject matter of Example 1, where the arm connects to an upper and left side of the body portion.

Example 3 includes the subject matter of Example 2, where the body portion defines a groove extending parallel to the central axis and positioned below a connection between the arm and the body portion.

Example 4 includes the subject matter of any of Examples 1-3 and further comprises a blocking portion protruding from a bottom of the body portion.

Example 5 includes the subject matter of Example 4, where the blocking portion has cuboid geometry.

Example 6 includes the subject matter of any of Examples 1-5, wherein the arm defines an arc from 70-120°.

Example 7 includes the subject matter of any of Examples 1-6, where the chamber flag is sized and configured for installation in a slide of a semiautomatic handgun, the slide having a right wall, a left wall, and a breechface between the right wall and the left wall, and wherein the slide defines an ejection port adjacent the breechface.

Example 8 includes the subject matter of Example 7, wherein a lateral dimension of the chamber flag from an outside surface of the arm to an opposite side surface of the body portion is greater than a lateral distance from an inside surface of the left wall of the slide to an inside surface of the right wall of the slide, thereby requiring deformation of the arm when the chamber flag is installed in the slide between the left wall and the right wall at the ejection port.

Example 9 includes the subject matter of Example 7 or 8 and further comprises a rear protrusion extending axially in a proximal direction from the body portion, the rear protrusion sized and configured to abut the breechface when the chamber flag is installed in the slide.

Example 10 includes the subject matter of Example 9, where the flag portion extends from a right side of the body portion and the arm extends from a left side of the body portion.

Example 11 is a combination of a chamber flag and a semiautomatic handgun, where the semiautomatic handgun has a frame and a slide extending along a bore axis and configured to reciprocate along a top of the frame, the semiautomatic handgun defining a chamber of a predefined caliber and the slide defining an ejection port, where the slide further includes a left wall, a right wall, and a breechface adjacent a proximal end of the ejection port between the right and left wall. The chamber flag is configured to be installed between the left wall and the right wall of the slide along the ejection port, where the chamber flag made of a flexible and resilient material. The chamber flag has a body portion extending along a central axis, a chamber portion extending axially from the body portion and that is sized and configured to be received in the chamber of the semiautomatic handgun. A flag portion extends from the body portion in a direction transverse to the central axis. An arm is connected to the body portion and extends circumferentially around a left side of the flag body in a radially spaced relationship with the body portion, where at least the arm is made of a flexible and resilient material.

Example 12 includes the subject matter of Example 11, where when the chamber flag is installed in the slide with the chamber portion extending into the chamber, the slide is in an out-of-battery position such that a hammer ramp on the breechblock or slide obstructs the hammer from striking the firing pin.

Example 13 includes the subject matter of Example 11 or 12, where when the chamber flag is installed in the slide, the arm engages an inside surface of the left wall of the slide and biases a right side of the body portion against an inside surface of the right wall, thereby retaining the chamber flag in the slide when the slide is cycled.

Example 14 includes the subject matter of Example 13, where when the slide is cycled, the chamber portion moves into and out of the chamber.

Example 15 includes the subject matter of any of Examples 11-14, where the arm connects to an upper and left side of the body portion.

Example 16 includes the subject matter of Example 15, where the body portion defines a groove extending parallel to the central axis and positioned below a connection between the arm and the body portion.

Example 17 includes the subject matter of any of Examples 11-16 where the chamber flag comprises a blocking portion protruding from a bottom of the body portion, where when the chamber flag is installed in the slide, the blocking portion prevents a magazine from seating in a magazine well of the semiautomatic handgun.

Example 18 includes the subject matter of Example 17, where the blocking portion has cuboid geometry.

Example 19 includes the subject matter of Example 11, wherein the arm defines an arc from 70-120°.

Example 20 includes the subject matter of any of Examples 11-19, where a lateral dimension of the chamber flag from an outside surface of the arm to a right side surface of the body portion is greater than a lateral distance from an inside surface of the left wall of the slide to an inside surface of the right wall of the slide, thereby requiring deformation of the arm towards the body portion when the chamber flag is installed in the slide between the left wall and the right wall at the ejection port.

Example 21 includes the subject matter of any of Examples 11-20, where the chamber flag includes a rear protrusion extending proximally from the body portion along the central axis, the rear protrusion sized and configured to abut the breechface when the chamber flag is installed in the slide.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A chamber flag for a firearm, the chamber flag comprising:

a body portion extending along a central axis;

a chamber portion extending axially from the body portion, the chamber portion sized and configured to be received in a chamber of the firearm;

a flag portion extending from the body portion in a direction transverse to the central axis; and an arm connected to the body portion and extending circumferentially around a left side of the body portion in a radially spaced relationship with the body portion, wherein at least the arm is made of a flexible and resilient material.

2. The chamber flag of claim 1, wherein the arm connects to an upper and left side of the body portion.

3. The chamber flag of claim 2, wherein the body portion defines a groove extending parallel to the central axis and positioned below a connection between the arm and the body portion.

4. The chamber flag of claim 1, wherein the arm defines an arc from 70-120°.

5. The chamber flag of claim 1, comprising a blocking portion protruding from a bottom of the body portion.

6. The chamber flag of claim 5, wherein the blocking portion has cuboid geometry.

7. The chamber flag of claim 1, wherein the chamber flag is sized and configured for installation in a slide of a semiautomatic handgun, the slide having a right wall, a left wall, and a breechface between the right wall and the left wall, and wherein the slide defines an ejection port adjacent the breechface.

8. The chamber flag of claim 7, wherein a lateral dimension of the chamber flag from an outside surface of the arm to an opposite side surface of the body portion is greater than a lateral distance from an inside surface of the left wall of the slide to an inside surface of the right wall of the slide, thereby requiring deformation of the arm when the chamber flag is installed in the slide between the left wall and the right wall at the ejection port.

9. The chamber flag of claim 8, comprising a rear protrusion extending axially in a proximal direction from the body portion, the rear protrusion sized and configured to abut the breechface when the chamber flag is installed in the slide.

10. The chamber flag of claim 9, wherein the flag portion extends from a right side of the body portion and the arm extends from a left side of the body portion.

11. In combination, a chamber flag and a semiautomatic handgun, the combination comprising:

a semiautomatic handgun with a frame and a slide extending along a bore axis, the semiautomatic handgun defining a chamber of a predefined caliber, wherein the slide is configured to reciprocate along a top of the frame and defines an ejection port, the slide further comprising:

a left wall;

a right wall; and a breechface adjacent a proximal end of the ejection port; and a chamber flag configured to be installed between the left wall and the right wall of the slide along the ejection port, the chamber flag made of a flexible and resilient material and comprising:

a body portion extending along a central axis;

a chamber portion extending axially from the body portion, the chamber portion sized and configured to be received in the chamber of the semiautomatic handgun;

a flag portion extending from the body portion in a direction transverse to the central axis; and an arm connected to the body portion and extending circumferentially around a left side of the body portion in a radially spaced relationship with the body portion.

12. The combination of claim 11, wherein when the chamber flag is installed in the slide with the chamber portion extending into the chamber, the slide is in an out-of-battery position that prevents firing the semiautomatic handgun.

13. The combination of claim 11, wherein when the chamber flag is installed in the slide, the arm engages an inside surface of the left wall of the slide and biases a right side of the body portion against an inside surface of the right wall, thereby retaining the chamber flag in the slide when the slide is cycled.

14. The combination of claim 13, wherein when the slide is cycled, the chamber portion moves into and out of the chamber.

15. The combination of claim 11, wherein the arm connects to an upper and left side of the body portion.

16. The combination of claim 15, wherein the body portion defines a groove extending parallel to the central axis and positioned below a connection between the arm and the body portion.

17. The combination of claim 11, comprising a blocking portion protruding from a bottom of the body portion, wherein when the chamber flag is installed in the slide, the blocking portion prevents a magazine from seating in a magazine well of the semiautomatic handgun.

18. The combination of claim 11, wherein the arm defines an arc from 70-120°.

19. The combination of claim 11, wherein a lateral dimension of the chamber flag from an outside surface of the arm to a right side surface of the body portion is greater than a lateral distance from an inside surface of the left wall of the slide to an inside surface of the right wall of the slide, thereby requiring deformation of the arm towards the body portion when the chamber flag is installed in the slide between the left wall and the right wall at the ejection port.

20. The combination of claim 11, comprising a rear protrusion extending axially in a proximal direction from the body portion, the rear protrusion sized and configured to abut the breechface when the chamber flag is installed in the slide.

* * * * *